United States Patent [19]

Kull

[11] 4,025,739

[45] May 24, 1977

[54] SELECTION AND TIMING CONTROL FOR BEVERAGE VENDING MACHINE

[75] Inventor: Leo Kull, West Caldwell, N.J.

[73] Assignee: Coffee-Mat Corporation, Kenilworth, N.J.

[22] Filed: Feb. 13, 1976

[21] Appl. No.: 657,745

[52] U.S. Cl. ..... 200/38 F; 194/10

[51] Int. Cl.² ..... H01H 7/08

[58] Field of Search ..... 194/10; 200/336, 27 A, 200/38 B, 38 BA, 38 R, 38 F, 38 FA, 38 FB

[56] References Cited

UNITED STATES PATENTS 3,478,181 11/1969 Buckerridge et al. ..... 200/38 B

*Primary Examiner*—Stanley H. Tollberg
*Attorney, Agent, or Firm*—William R. Liberman

[57] ABSTRACT

A sequencing and timing mechanism in a beverage vending machine includes a plurality of circular cams mounted on a common shaft driven by a low speed motor, and a follower is movable into engagement with each cam and actuates a corresponding switch. Freely rockably supported by each cam is a member which releasably retains a respective follower in a retracted condition and a powder feed motor is connected through each switch to a current source. A series of push buttons engage a first locking member which is releasably locked in locking position by a second locking member which, in turn, is releasably locked in a release condition by a solenoid actuated dog, the solenoid being pulse excited by a coin actuated switch. A restrictor permits the advance of only a single button which is releasably locked by the first locking member and advances a respective preselected group of follower retaining members to release position so that upon energization of the motor which rotates the cams a single revolution, a corresponding group of feed motors is energized. The cams are adjustable to effect the relative lengths of the raised and recessed portions and hence the feed motor energization intervals.

18 Claims, 17 Drawing Figures

SELECTION AND TIMING CONTROL FOR BEVERAGE VENDING MACHINE

BACKGROUND OF THE INVENTION

The present invention relates generally to improvements in control mechanisms and it relates particularly to an improved operation sequencing and timing mechanism for dispensing and vending machines for beverages and the like.

In the conventional hot beverage vending machine it is the common practice to provide the customer with a wide range of choices as to the beverage additives. Thus, in the machine dispensing of coffee, the coffee, sugar and creamer are usually storaged as powders and are automatically metered into the dispensed beverages in accordance with the customer's selection, that is, black coffee, coffee with cream or extra cream, coffee with sugar or extra sugar, or combinations thereof. However, the mechanisms heretofore available and proposed allowing a wide range of beverage ingredient solutions, as above, possess numerous drawbacks and disadvantages. They are highly complex and complicated, and employ numerous electrical components such as relays and the like; they are bulky and unreliable, difficult to service and maintain, and they are expensive and of little versatility and adaptability.

SUMMARY OF THE INVENTION

It is accordingly a principal object of the present invention to provide an improved control mechanism.

Another object of the present invention is to provide an improved sequencing and timing mechanism.

Still another object of the present invention is to provide an improved selector mechanism for control of the dispensing programming of a vending machine.

A further object of the present invention is to provide an improved machine for the vending of hot beverages such as coffee or the like in which the customer is given a wide range of choices as to the dispensed beverage and the ingredients and quantities thereof.

Still a further object of the present invention is to provide an improved mechanism of the above nature characterized by its high reliability, ruggedness, compactness, simplicity, ease of servicing and maintenance, relatively low cost, and high versatility and adaptability.

The above and other objects of the present invention will become apparent from a reading of the following description taken in conjunction with the accompanying drawings which illustrate a preferred embodiment thereof.

In a sense the present invention contemplates the provision of an electromechanical control mechanism comprising a control cam, a motor drive for rotating the control cam, a cam follower movable into engagement with the cam, a switch movable between actuated and deactuated positions in response to the position of the cam follower, means responsive to the actuation of the switch, and means releasably retaining the cam follower in a retracted position independently of the position of the control cam. Another feature of the present invention resides in a selector mechanism comprising a plurality of selectively actuated actuator members individually movable between advanced and retracted positions, a first locking member movable in response to the advance of a selected selector member to an advanced position releasably locking the advanced selector member in its advanced position, a second locking member movable between an advanced position releasably locking the first locking member in its advanced position and a retracted position releasing the first locking member, electrically actuated means releasably locking the second locking member in its retracted position and a plurality of actuating members responsive to the advance of respective selector members.

In the preferred construction of the selector mechanism the first locking member is a vertical plate swingable about a vertical axis and having vertically spaced openings which slidably engage respective selector members having side notches which releasably engage side edge of an opening when the locking plate and a respective selector member are in their advanced position, the first locking member being spring retracted. The second locking member includes a horizontal plate swingable about a vertical axis and having a notch engaging the first locking member when both locking members are in their advanced position. A dog releasably engages a shoulder on the second locking member to releasably retain it in its lock position and is retracted by a solenoid actuated mechanism to release the second locking member. In the control mechanism a plurality of cams are mounted on a motor driven drive shaft and each has raised and depressed portions of relatively adjustable lengths and a follower retractor member is rockably supported by each cam and includes raised and depressed portions alternatively movable into registry with a respective cam follower to respectively retract and release the follower into engagement with a control cam. A mechanism is provided to rock a preselected group of follower retractor members by the advance of a selector member, and ingredient feed motors are connected in series with one or more of the switches to a source of current. The cam drive shaft is rotated a single revolution for each vending cycle and is coin initiated.

The improved selector and control mechanism is rugged and reliable, simple to service and maintain, compact and of great versatility and adaptability.

DESCRIPTION OF THE PREFERRED EMBODIMENT

Figure 1:
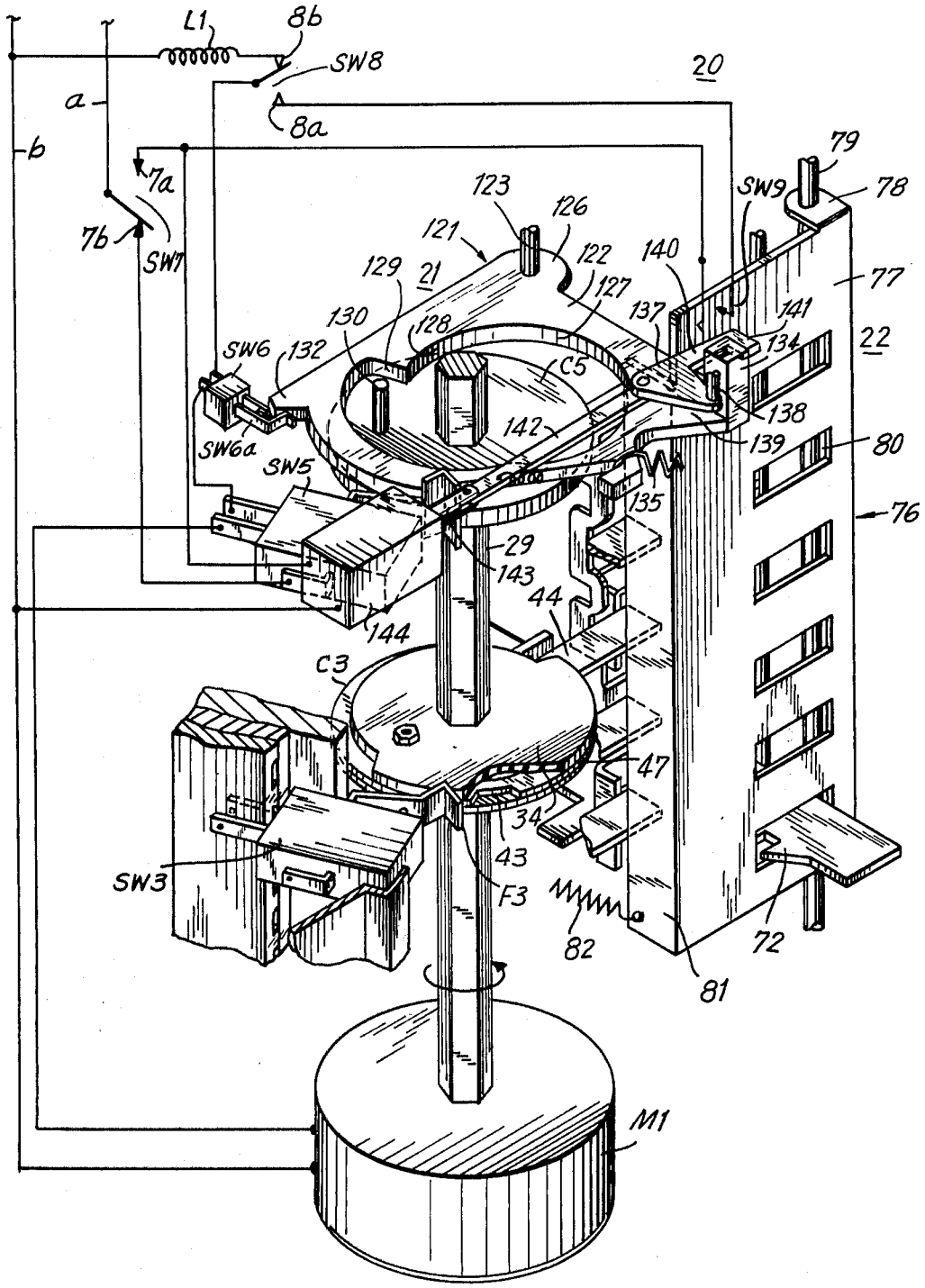
FIG. 1 is a fragmental, partial rear perspective and schematic view of a mechanism embodying the present invention.

Referring now to the drawings which illustrate a preferred embodiment of the present invention as applied to a machine for vending coffee with or without sugar and creamer and adjustably usable for the vending of other beverages as well such as tea and soup, the reference numeral 20 generally designates the improved mechanism which includes a control section 21 for sequencing and timing the operations of a vending cycle an a selector section 22 affording a customer a beverage and composition choice. Aside from the improved mechanism, the beverage vending machine may be of known or conventional construction and includes a water heating and storage tank, valve and metering devices for the water and the various ingredients such as powdered coffee, sugar, powdered creamer, powdered tea, soup and the like, a cup storage and dispensing mechanism, a coin receiver and actuator etc., the various components being housed in a cabinet provided with a front door 23 affording access to the interior of the cabinet.

Mounted on the inside face of front door 23 is a support frame 24 including top and bottom vertically spaced horizontal plates 26 and 27 respectively joined at their end edges by a transverse vertical end plate 28. A vertical cam drive shaft 29 of hexagonal transverse cross section extends between and is journalled to frame plates 26 and 27 and is connected at its bottom end by way of a speed reducing gear train to the output of a low speed electric motor M1 which is secured to the underface of frame plate 27. Mounted on the lower portion of cam shaft 29 are, by way of example, four vertically spaced cam and follower locking assemblies C1, C2, C3 and C4, and on the upper portion thereof spaced from the assembly C4, a cycle control cam C5.

Figure 15:
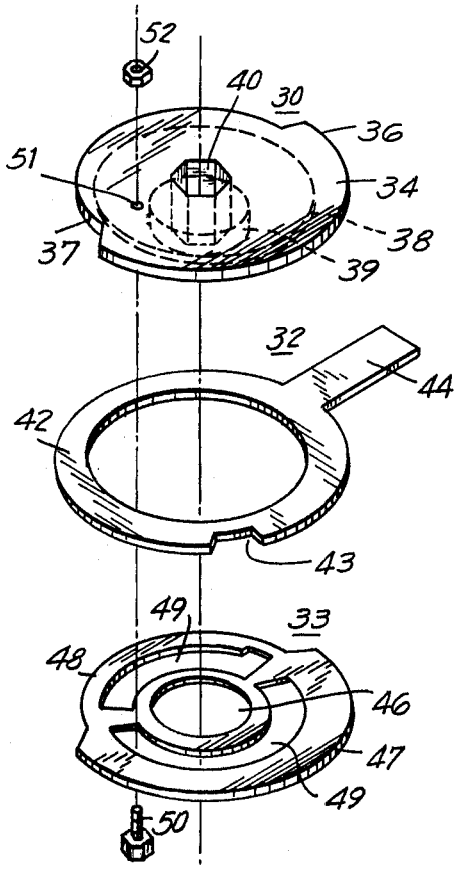
FIG. 15 is an exploded perspective view of one of the control cams and cam follower retractor assemblies of the control mechanism.
Figure 16:
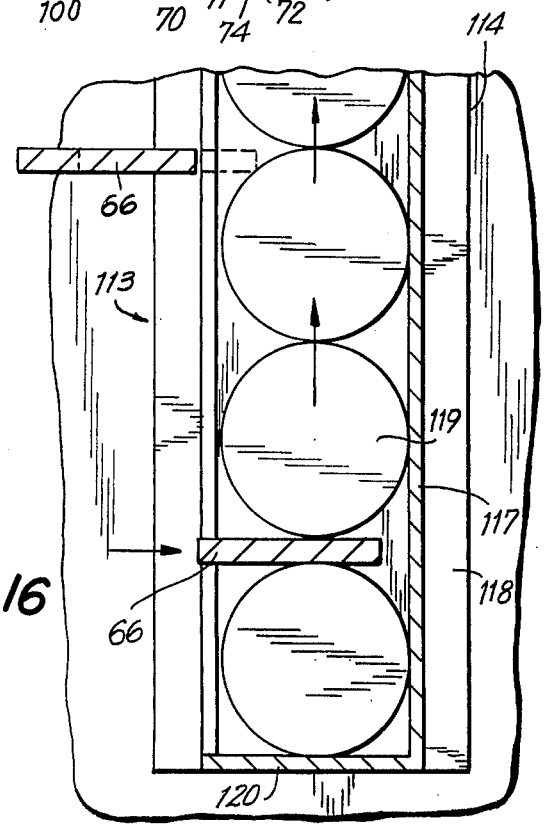
FIG. 16 is an enlarged perspective view taken along line 16—16 in FIG. 7.

As best seen in FIG. 15, each of the cam assemblies C1–C4 includes a first cam section 30, a follower retractor 32 and a second cam section 33. The first cam section 30 is integrally formed and includes a top portion 34 with a peripheral cam surface comprising a circular raised section 36 and an inwardly offset concentric circular depressed section 37. Formed on the underface of top portion 34 and coaxial therewith is a depending coaxial shallow projection 38 of large diameter and depending from projection 38 is a cylindrical hub 39, the cam section 30 having a hexagonal axial bore 40 which tightly engages cam shaft 29 so that cam section 30 is affixed thereto and rotatable therewith.

The follower retractor member 32 is flat and includes an annular body member 42 which is slightly less than the thickness of and rotatably coaxially matingly engages the projection 38. The outer peripheral edge of body member 42 coincides with the outer periphery of raised cam portion 36 and has a short arcuately extending recess 43 therein at least as deep as the radial depth of depressed cam portion 37. Projecting radially outwardly from body member 42 and angularly spaced from recess 43 is an actuating arm 44.

The bottom or second cam section 33 is circular and flat and has a central bore 46 matingly engaging the hub 39 an has concentric raised and depressed arcuate peripheral cam edges 47 and 48 respectively of radii equal to those of cam edges 36 and 37. A pair of peripherally spaced end to end arcuate slots 49 of the same radius are formed in cam section 33, coaxial therewith, and a screw 50 registers one of slots 49 and a bore 51 in cam section 30 and is engaged by a nut 52. Thus, the lengths of the raised and depressed portions of the cam including sections 30 and 33 may be adjusted by loosening nut 52 relatively angularly adjusting cam sections 30 and 33 and tightening nut 52. The retractor 32 is fully rockable on the cam assembly to control the angular position of recess 43.

The cam C5 is affixed to the upper portion of shaft 29 and is circular and includes a short depression 53 and functions to control the motor M1 to rotate shaft 29 to a single revolution for a dispensing cycle. Also affixed to and rotated by the shaft 29 are a plurality of vertically spaced circular cams above cam C4 which serve the sequencing and timing functions hereinafter described as well the timing and sequencing of other of the beverage vending operations such as the dispensing of a cup and other operations.

Laterally spaced from the cam assemblies and cams C1 to C5 and extending vertically between and supported by frame plates 26 and 27 is a vertical switch mounting bar 54 of suitable construction which replaceably supports, in addition to other operation control switches, normally closed switches SW1 to SW4 at the levels of cams C1 to C4 respectively, and double through switch SW5 at the level of cam C5. The switches SW1 to SW4 are of the microswitch type and include resilient actuating arms A1 to A4 respectively which terminate in integrally formed cam followers F1 to F4 of vertical dihedral angle configuration which are resiliently urged into engagement with the peripheral surfaces of cam assemblies C1 to C4. Similarly, the switch SW5 is of the microswitch type and includes an actuating arm A5 terminating in a vertical dihedral angle shaped follower F5 resiliently urged into engagement with cam C5. Each switch SW1 to SW4 is actuated to its closed position when its respective follower F1 to F4 engages the depressed portion of a corresponding cam assembly C1 to C4 and the retractor recess 43, otherwise the switch is in its deactuated open position.

Figure 14:
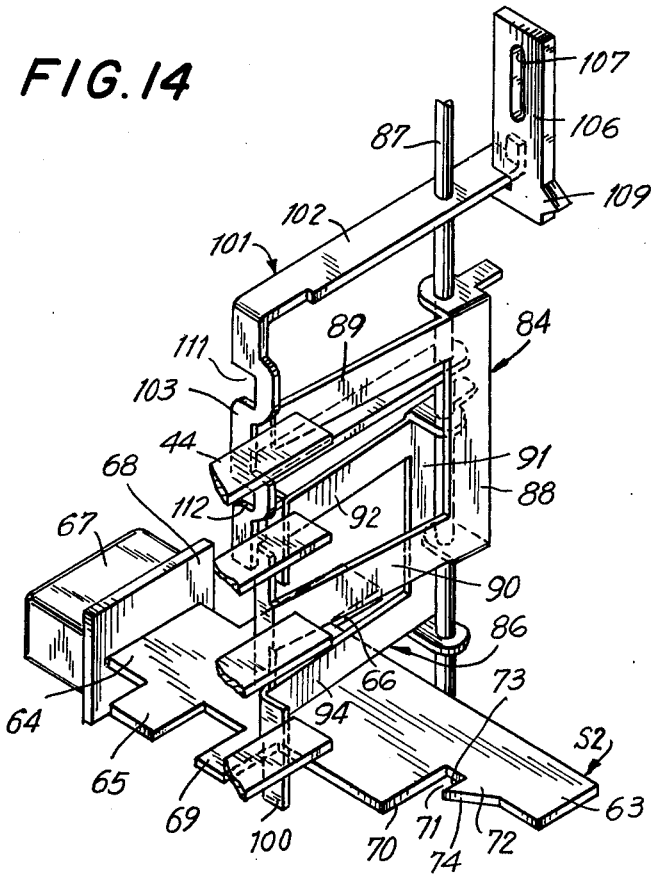
FIG. 14 is a rear perspective view of a portion of the selector mechanism.

The selector section 22 includes a vertical guide plate 56 directed laterally inwardly from the rear portion of frame plate 28 and has formed therein regularly vertically spaced horizontal guide slots which are transversely aligned with correspondingly shaped and spaced guide slots formed in the base 57 of a rectangular well 58 in the front face of door 23. The well 58 is covered by a face plate 59 having vertically spaced rectangular openings in transverse alignment with respective pairs of the guide slots. There are provided a plurality of vertically spaced individually transversely slidable selector plates S1 to S6. As best seen in FIG. 14, each of the selector plates S has a rear tongue 63 slidably engaging a guide slot in plate 56 and a front tongue 64 slidably engaging a corresponding aligned guide slot in well base 57. Formed in opposite sides of each selector plate S at the base of front tongue 64 are a laterally projecting stop arm 65 and an opposite laterally projecting restrictor finger 66. A push button 67 is affixed to the front end of each tongue 64 and projects through a respective face plate opening 60 and is provided with a peripherally enlarged, stop defining base 68 located in well 58. A laterally projecting actuating finger 69 projects laterally from each plate S forwardly of stop arm 65 and at the forward base of each guide tongue 63 there is provided a laterally extending shoulder 70 in the same side as actuating finger 69. Positioned along the side edge of tongue 63 and separated from shoulder 70 by a locking recess 71 is a triangular projection 72 including a front edge 73 parallel to shoulder 70 and a cam defining rearwardly inwardly inclined rear edge 74.

A first locking plate 76 is dispersed forwardly of guide plate 56 and is swingable about a vertical axis and includes a vertical lateral plate 77 provided at top and bottom corners with forwardly directed horizontal lugs 78 rockably engaging a vertical rod 79 extending between and supported by frame plates 26 and 27 proximate frame plate 24. Formed in plate 77 are vertically spaced locking openings 80 which slidably engage corresponding selector plates S forwardly of guide plate 56 and are of a width which permit the passage of a selector plate triangular projection 72 but not the shoulder 70 thereof so as to allow the movement of a selector plate to bring the recess 71 thereof into engagement with a border of a locking opening 80. Formed along the free edge of plate 77 from the bottom to a point short of the top thereof is a forwardly directed flange 81 to the bottom corner of which is connected a helical tension spring 81 to bias the free end of the locking plate 76 rearwardly to its retracted unlock position. The swinging path of the vertical edge of flange 81 is intercepted by the rear edges of retractor fingers 44.

Desposed directly forwardly of retractor fingers 44 are a pair of vertically spaced, vertically overlapping upper and lower U-shaped, upper and lower shift yokes 84 and 86 respectively which are swingably supported by a vertical rod 87 extending between frame plates 26 and 27. Upper yoke 84 includes a vertical cross arm 88 having forwardly projecting top and bottom lugs engaging rod 87 and vertically spaced parallel horizontal top and bottom side arms 89 and 90 respectively projecting between selector plates S5 and S6 and between selector plates S3 and S4. Lower yoke 86 includes a vertical cross arm 91 having rearwardly projecting top and bottom lugs engaging rod 87 and vertically spaced parallel horizontal top and bottom side arms 92 and 94 respectively projecting between selector plates S4 and S5 and between selector plates S2 and S3.

Figure 8:
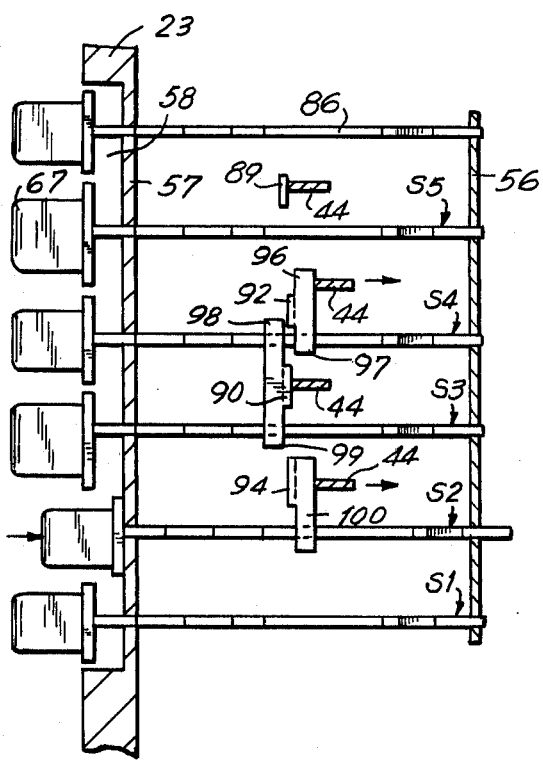
FIG. 8 is a partial sectional view taken along line 5—5 in FIG. 3 showing the condition with the depression of a selected choice button.
Figure 9:
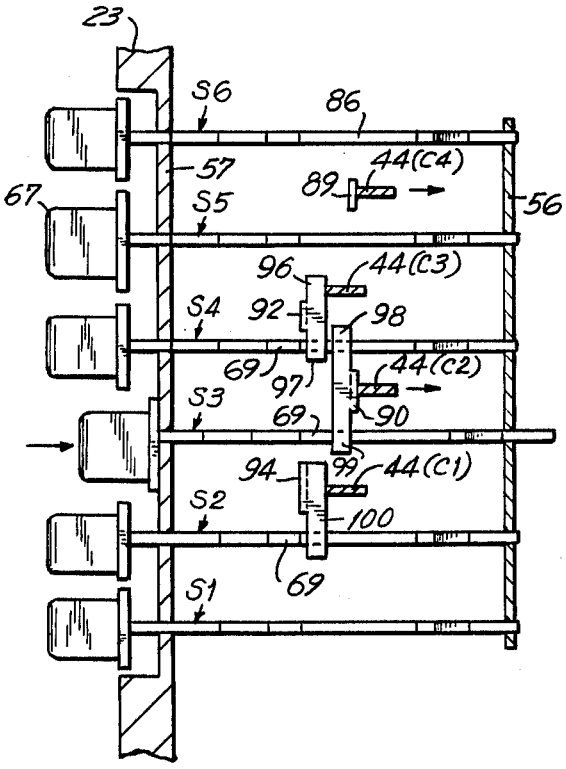
FIG. 9 is a view similar to FIG. 8 showing the condition with the depression of another choice button.
Figure 10:
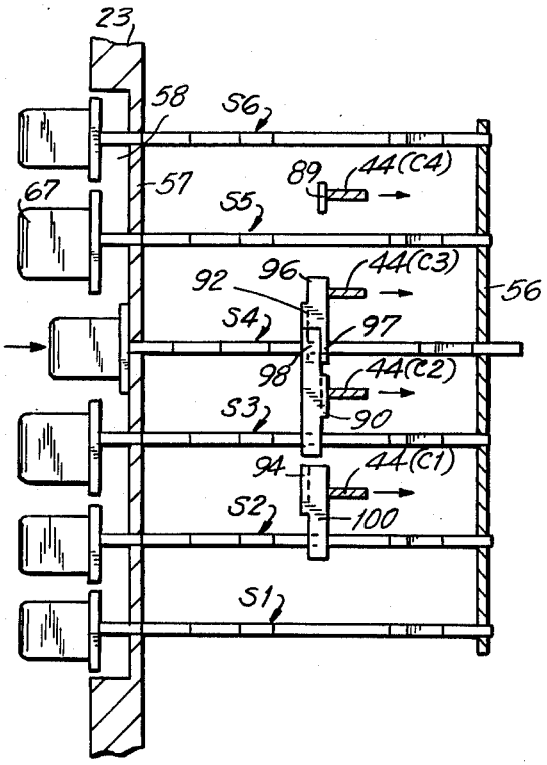
FIG. 10 is a view similar to FIGS. 8 and 9 but showing the condition with the depression of still another choice button.

The retractor actuator arm 44 of cam assembly C4 lies in the swing path of yoke arm 89. Yoke arm 92 terminates in an upper finger 96 whose swing path is intercepted by actuator arm 44 of cam assembly C3 and a depending lower finger 97 lying in the path of finger 69 of selector plate S4. Yoke arm 90 terminates in upwardly and downwardly directed fingers 98 and 99 lying respectively in the paths of fingers 69 of selector plates S3 and S4, the actuator arm 44 of cam assembly C2 lying in the path of yoke arm 90. The yoke arm 94 terminates a depending finger 100 which registers with the path of finger 69 of selector plate S2 and the actuator arm 44 of cam assembly C1. Thus when the lowermost or black coffee selector plate S1 is push button advanced, neither yoke is advanced; when the light coffee selector plate S2 is push button advanced, lower yoke 86 is swung to advance actuator arms 44 of cam assemblies C1 and C3 as shown in FIG. 8; when the squared coffee selector plate S3 is push button advanced, upper yoke 84 is swung to advance actuator arms 44 of cam assemblies C2 and C4 as shown in FIG. 9; and when the sugared light coffee selector plate S4 is push button advanced, both yokes are swung to advance all four actuator arms 44 as shown in FIG. 10.

In order to actuate the cream and sugar control retractors 32 of cam assemblies C3 and C4 by push button actuated selector plates S5 and S6, there is provided a selectively adjustable transfer member 101 which is selectively adjustably responsive to the advance of neither, the lower, or both selector plates. The transfer member 101 includes a horizontal lever 102 swingable and vertically adjustable on rod 87 above upper yoke 84 and terminates in a depending vertical arm 103 disposed outwardly of yokes 84 and 86 and swing path is intercepted by actuator arms of cam assemblies C3 and C4 and which lies in the path of the fingers of selector plates S5 and S6.

The end of lever 102 opposite to that of arm 103 projects beyond rod 87 through an opening in vertical frame plate 28 into horizontal sliding engagement with a horizontal guide recess 104 formed in the front edge of an adjustment plate 106. The adjustment plate 106 has a vertical slot 107 engaged by a screw 108 which engages a tapped bore in frame plate 28 to permit the vertical adjustment and setting of adjustment plate 106. The plate 106 has a pointed horizontal hand 109 which registers with index 110 on the outer face of plate 28 to indicate the vertical position of adjustment plate 106.

Figure 11:
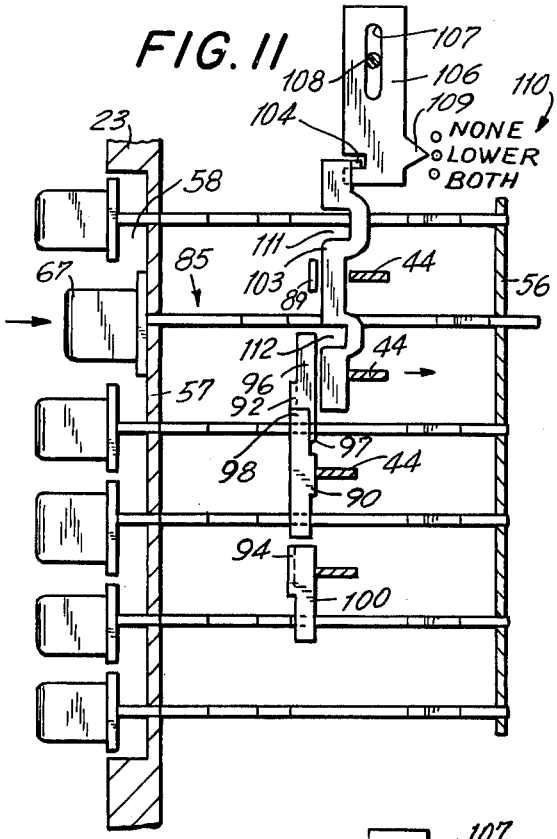
FIG. 11 is a view similar to FIG. 8 showing the depression of another button and the adjustment of the mechanism to a selected state.
Figure 12:
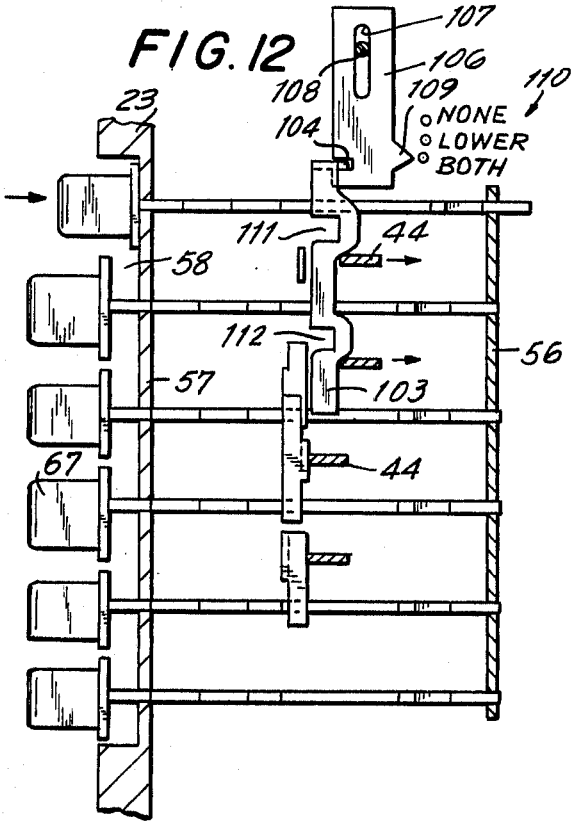
FIG. 12 is a view similar to FIG. 11 showing the depression of another button and another adjustment of the mechanism.
Figure 13:
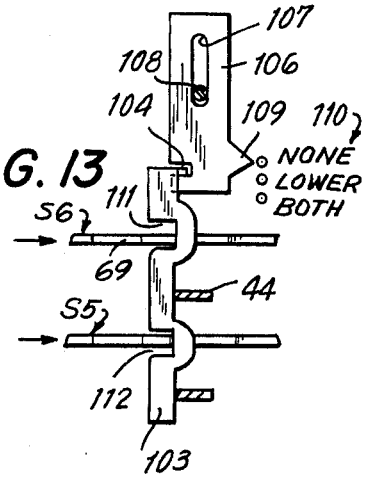
FIG. 13 is a partial view similar to FIG. 12 showing a further adjustment of the selector mechanism.

Formed in the arm 103 in confrontation with the fingers 69 of selector plates S5 and S6 are vertical spaced upper and lower recesses 111 and 112 respectively. The recesses 111 and 112 are so spaced and dimensioned that when the arm 103 is in its adjusted upper position as shown in FIG. 13, recesses 111 and 112 register with the paths of fingers 69 of selector plates S5 and S6. When the arm 103 is in its adjusted lower position as shown in FIG. 12, the recesses 111 and 112 are out of registry with both fingers 69, and when the arm 103 is in its adjusted intermediate position, as shown in FIG. 11, the upper recess 111 registers with the finger 69 of selector plate S6 and the lower recess 112 is out of registry with the finger 69 of selector plate S5. The actuator arms 44 of cam assemblies C3 and C4 lie in the path of arm 103. Thus when adjustment plate 106 is in its upper position, the advance of neither of the selector plates S5 and S6 will advance the retractor arms 44 of cam assemblies C3; when adjustment plate 106 is in its bottom position, advance of either selector plate S5 or S6 will advance both actuator arms; and when the adjustment plate 106 is in its intermediate position, as shown in FIG. 11, only the advance of selector plate S5 will advance both actuator arms.

In order to limit the selector mechanism to the advance of only a single selector plate S at a time, there is positioned on the inside face of the frame plate 28 proximate the selector plate fingers 66 a restrictor device 113 of generally known construction. The restrictor device 113 includes a vertical channel member 114 having a cross wall 116 opposite side legs 117 terminating in flanges 118 secured to frame plate 28. Vertically spaced transverse and lateral slots of the thicknesses of fingers 66 are formed in cross wall 116 and front channel leg 117 in transverse alignment with respective fingers 66. A plurality of discs 119 are stacked peripherally end to end in the channel member 114 with their points of contact being at the medial level of corresponding fingers 66, the stack resting on a bottom wall 120 of the channel member and being restricted to a vertical movement equal to about the thickness of a finger 66 by a top stop. Thus, a finger 66 is permitted to advance through aligned slots in channel member 114 between a pair of discs 119 by raising the overlying discs, but an additional finger 66 cannot be advanced since it is stopped by the discs which are prevented from further separating.

The first locking member 76 is releasably locked in its advanced position by a second locking member 121 which is in the form of a horizontal flat plate 122 lying in a horizontal plane above the cam C5 and pivotly supported below the frame top plate 26 by a vertical pivot pin 123 depending from plate 26 and engaging a lug 126 at a front corner of plate 122. A large opening 127 is formed in locking plate 122 and is delineated by a single convolution, approximately spiral cam surface 128 whose ends are connected by a radial shoulder 129. A vertical follower pin 130 is eccentric to and extends upwardly from cam C5 into opening 127 and is movable with the rotation of cam C5 along cam surface 128.

Figure 2:
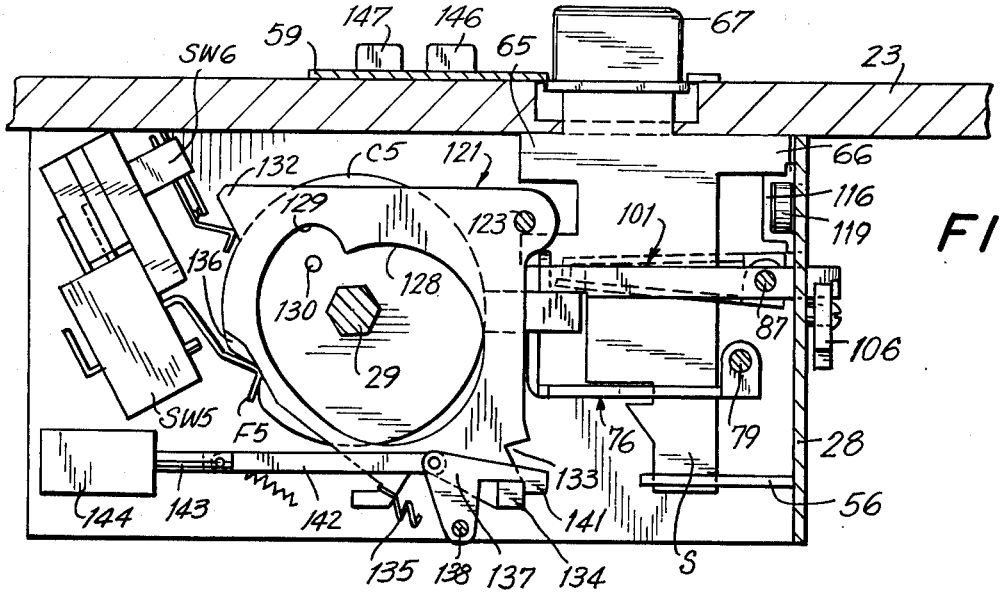
FIG. 2 is a top plan view thereof shown in its dormant position thereof.
Figure 3:
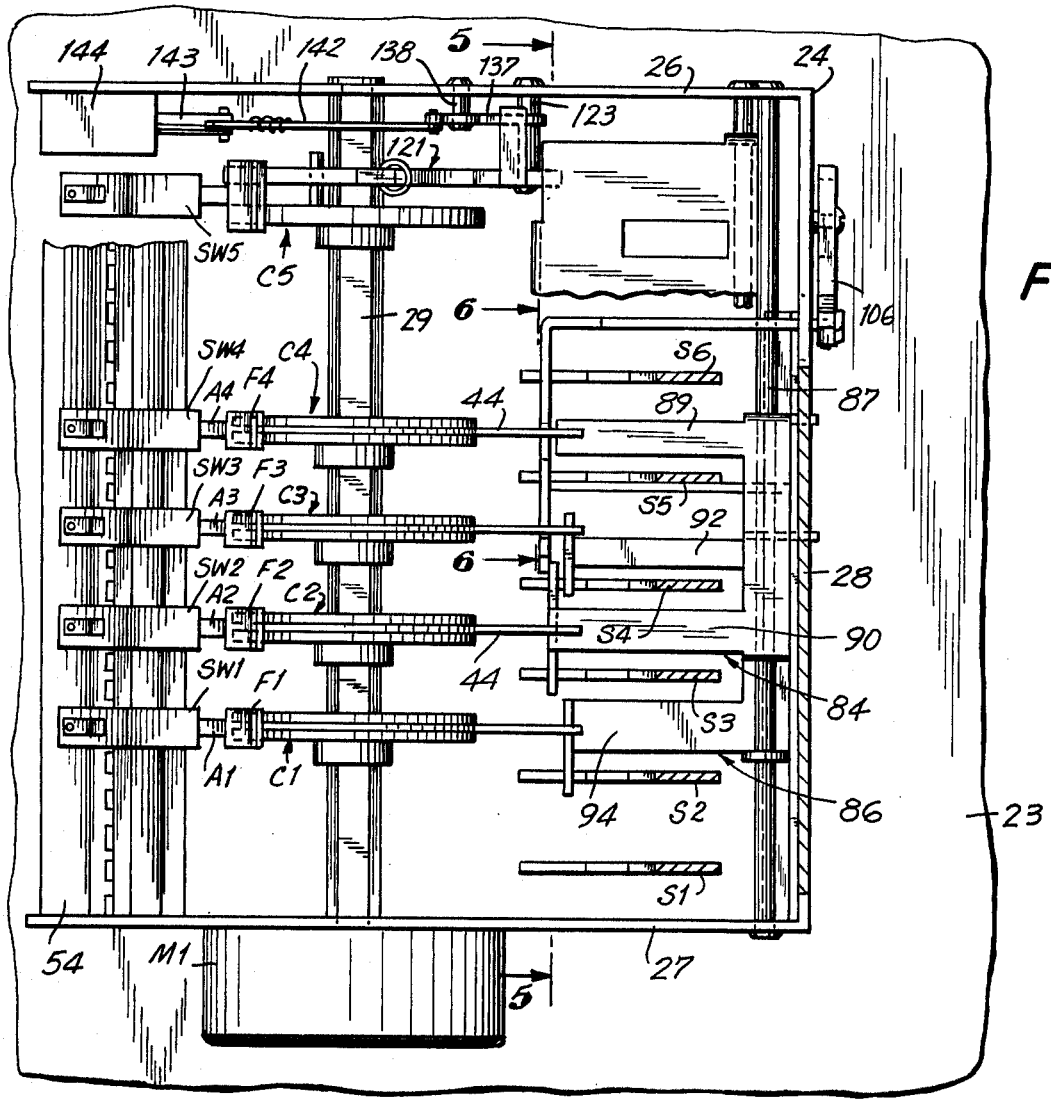
FIG. 3 is a rear elevational view thereof.
Figure 4:
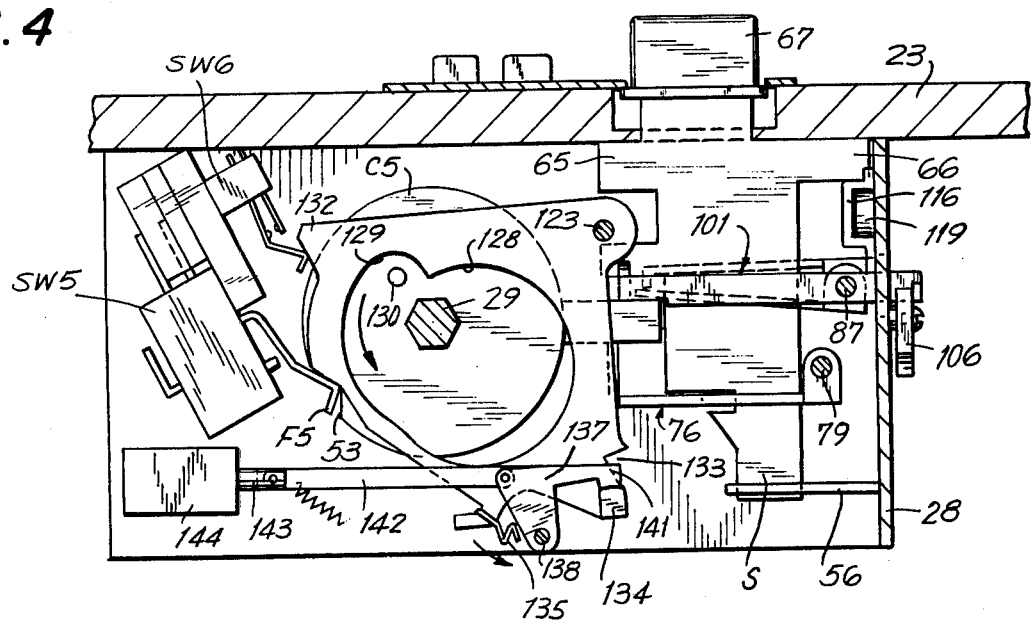
FIG. 4 is a view similar to FIG. 2 showing the mechanism in its initial ready stage of operation.
Figure 5:
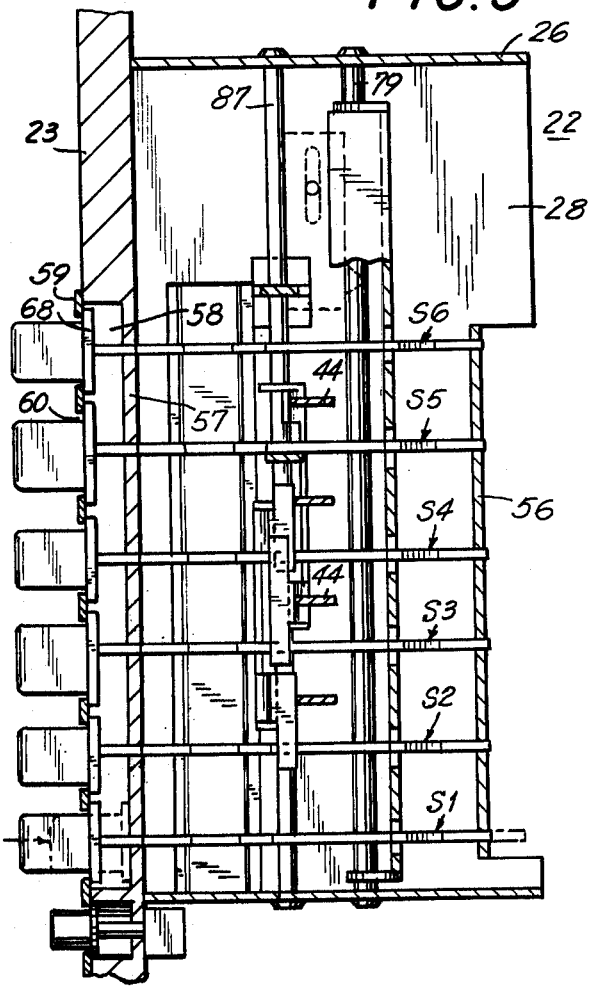
FIG. 5 is a sectional view taken along line 5—5 in FIG. 3.
Figure 6:
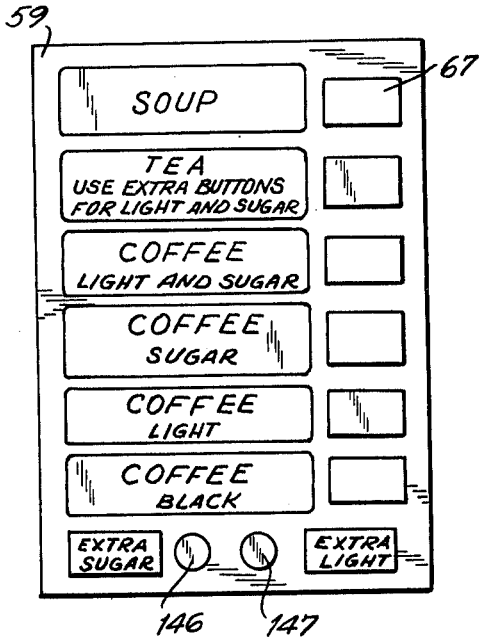
FIG. 6 is a front elevational view of the selector panel.
Figure 7:
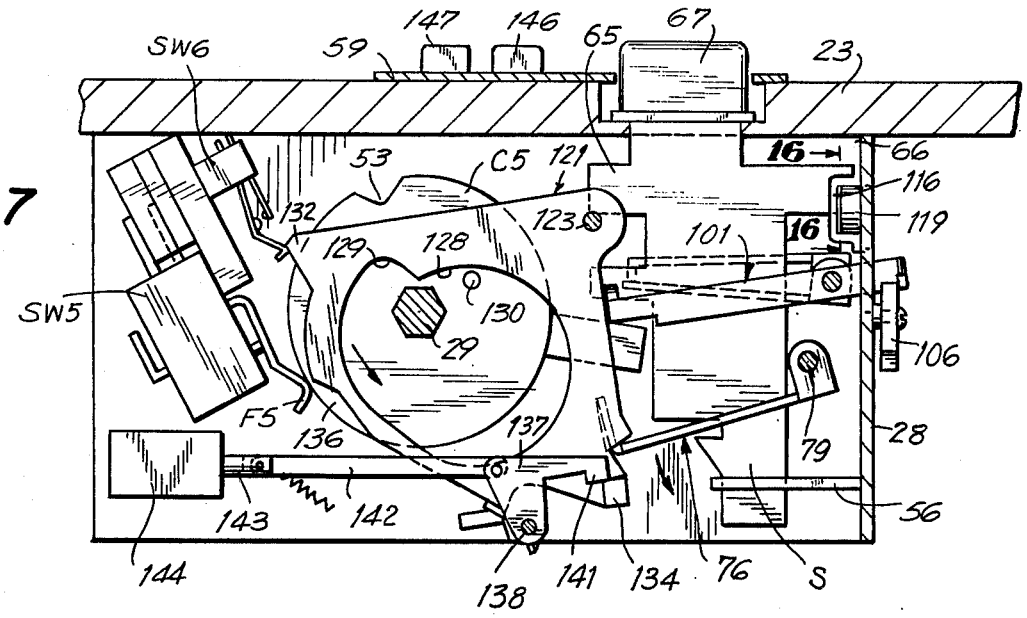
FIG. 7 is a view similar to FIG. 2 showing the mechanism during the dispensing cycle.

A laterally projecting finger 132 is formed at the front corner of plate 122 opposite its pivoted corner and engages the arm SW6a of a normally closed, suitably mounted switch SW6 so as to open and close switch SW6 with the counterclockwise and clockwise swinging respectively of plate 122 as viewed in FIGS. 1 and 2. Formed in the rear side edge of plate 122 at the end thereof, transversely remote from lug 126, is a notch 133 which in the advanced counterclockwise position of plate 122 and the advanced position of lock plate 77 engages the proximate upper edge of plate 77 to releasably lock plate 77 in its advanced position by a spring 135 and a latch block 134 projects upwardly from the corner of plate 122 adjacent to notch 133. A recess 136 is formed in the edge of plate 122 adjacent to follower F5, the recess engaging the follower when the plate 122 is in retracted position, as shown in FIGS. 1 and 2, to release switch SW5 and disingages the follower when the plate is in its advanced position, as shown in FIG. 7, to actuate switch SW5. Thus, switch SW5 is deactuated only when both recess 53 in cam C5 and recess 136 engage follower F5.

The second locking member 121 is releasably locked in its retracted position against the influence of spring 135 by a bell crank shaped pawl or dog member swingably supported about a vertical axis by a pivot pin 138 depending from frame plate 26 and engaging an opening in the end of one arm 139 of pawl member 137. The other arm 140 of pawl member 137 terminates in a stop defining inwardly directed leg 141 which engages the block 134 when locking member 121 is in its retracted position to releasably lock member 121 in its retracted position. The knee of pawl member 137 is connected by a link 142 to the spring advanced plunger armature 143 of an actuating solenoid 144 mounted on the underface of frame plate 26. Thus, excitation of the solenoid 144 swings pawl member 137 counterclockwise to disengage block 134 and release the second locking member 121 to permit its locking the first locking member 76 upon advance of the first locking member.

Figure 17:
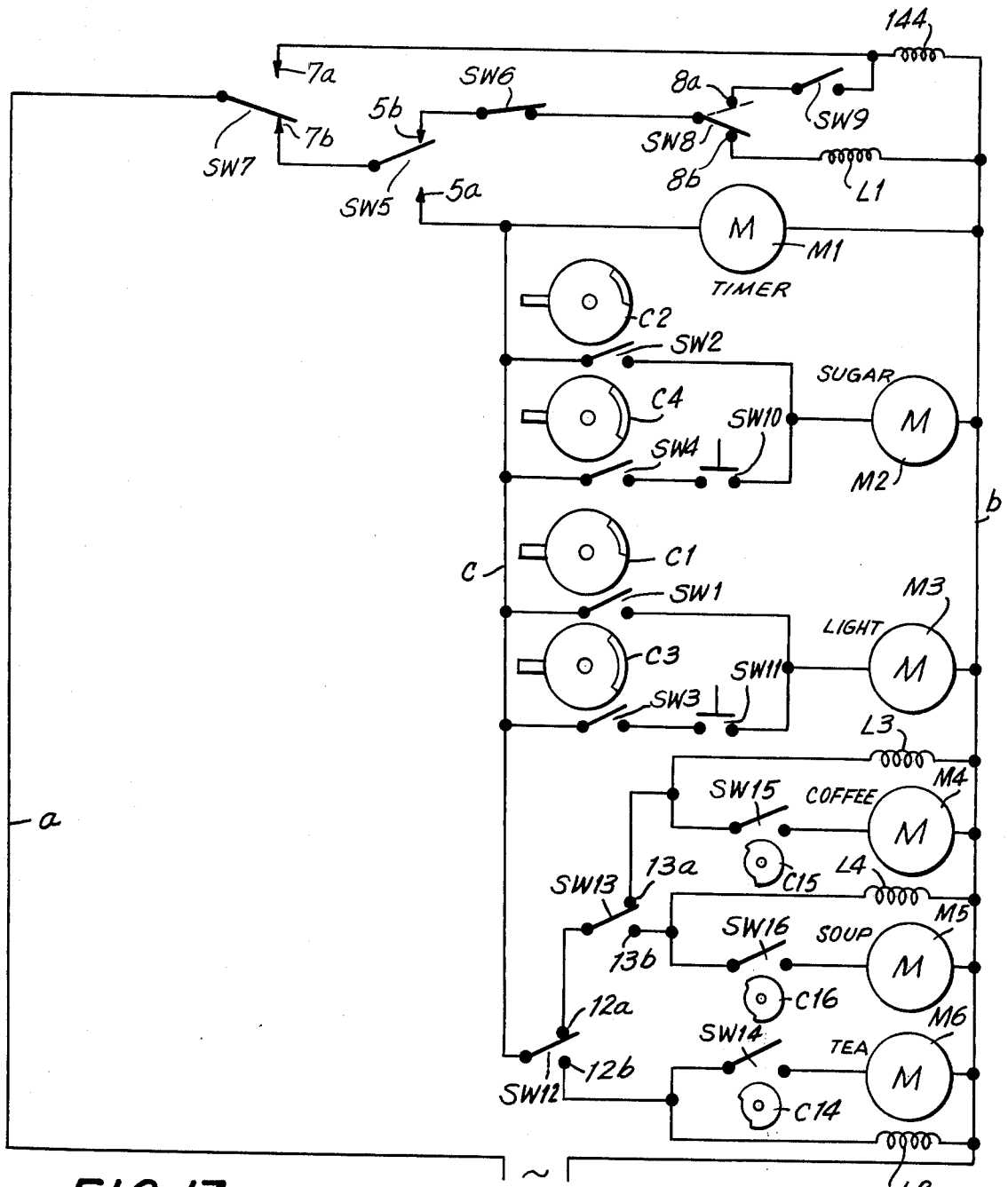
FIG. 17 is a schematic diagram of the control circuit of the control mechanism.

Referring now to FIG. 17 which illustrates the circuit network of the improved mechanism, the network being energized by a suitable AC current source by way of lines a and b and including in addition to timer motor M1, a motor M2 motivating the sugar feed device, a motor M3 motivating the powdered creamer feed device, a motor M4 motivating the powdered coffee feed device, a motor M5 motivating a powdered soup feed device, and a motor M6 motivating a powdered tea feed device, the various feed devices being of known construction and leading from a powder storage to a discharge mixing chamber. A coin operated switch SW7 part of a coin receiver of known construction has its arm connected to line a, a normally open contact 7*a* connected through solenoid 144 to line *b* and a normally closed contact 7*b* connected to the arm of double throw switch SW5 whose normally open contact 5*a* is connected through motor M1 to line *b* and whose normally closed contact 5*b* is connected to the arm of a free vend double throw switch SW8. One contact 8*a* of switch SW8 is connected in series through a normally open plate 77 operated switch SW9 and solenoid 144 to line *b* and the other contact 8*b* thereof is connected through a coin return solenoid Ll to line *b*, energization and deenergization of solenoid Ll preventing the reception of and rejecting and returning a coin respectively inserted in the coin slot. Switch contact 5a is connected to line c and switch SW2 is connected in series with motor M2 between lines *b* and *c* and switch SW1 is connected in series with motor M3 between lines *b* and c. Connected in parallel with switch SW2 are the series connected switch SW4 and push button normally open switch SW10 operable by push button 146 accessible on the front door and connected in parallel with switch SW1 are the series connected switch SW3 and push button normally open switch SW11 operable by push button 147 also accessible on the front door, the push buttons 146 and 147 being located on face plate 59 and being suitably designated.

The arm of a double throw switch SW12 is connected to line *c* and its normally closed contact 12*a* is connected to the arm of a double throw switch SW13 and its normally open contact 12b is connected in series through a cam operated switch SW14 and motor M6 to line b and through a hot water valve solenoid L2 to line *b*. The normally closed contact 13*a* of switch SW13 is connected in series through a cam operated switch SW15 and motor M4 to line *b* and through a hot water valve solenoid L3 to line b and its normally open contact 13*b* is connected in series through a cam operated switch SW16 and motor M5 in line *b* and through a hot water valve solenoid L4 to line *b*.

The switches SW14, SW15 and SW16 are operated by cams C14, C15 and C16 respectively which are mounted on and rotated by shaft 29, the switches SW14, SW15 and SW16 being mounted on switch panel 54, the cams timing the motivation of respective feed motors M4, M5 and M6. The arm of switch S12 is transferred to contact 12b by advance of selector plate S5 and the arm of switch SW13 is transferred to contact 13b upon advance of selector plate S6 by any suitable arrangement. The solenoids L2, L3 and L4, when engaged, open the valve between the machine hot water storage and the machine beverage discharge.

Considering now the operation of the improved machine described above, in its rest operative state as shown in FIGS. 1 to 3 and 17, only the coin return solenoid L1 is energized to permit the operative reception of a coin, the second locking member 121 being in its retracted position locked by pawl member 137 and the first locking member 76 being in its retracted position. Upon the insertion of a coin the switch SW7 is momentarily switched to contact 7*a* to pulse the solenoid 144 which retracts the pawl member 137 which in turn releases second locking member 121 for advanced spring influenced movement. A selection of the buttons 67 is then depressed to advance a corresponding selector plate S, the cam edge 74 thereof bearing on an edge of a respective plate opening 80 to swing first locking member 70 so that a recess 71 in selector plate S engages the opening side edge and the notch 133 in second locking member 121 engages the edge of locking plate 77 to lock the locking member 77 and the advanced selector plate S in their advanced positions against the action of retractor spring 82 as shown in FIG. 7. In this fully advanced position of second locking member 121 the switch SW5 is transferred to contact 5*a* by reason of recess 136 being shifted out of registry with follower F5 to energize motor M1 and rotate shaft 29 and the cams carried thereby. With the rotation of cam C5 the cam recess 53 is advanced out of engagement with follower F5 to maintain switch SW 5 in the position energizing motor M1. With the continued rotation of shaft 29 the shaft rotated cams sequence and time the preselected machine operation and the pin 130 advanced in engagement with cam surface 128 to retract second locking member 121 to its retracted locked position causing pawl member 137 to engage block 134 and lock the second locking member in its retracted position, the selector plate being shifted by the retracted first locking member 76 to its retracted position. The further rotation of shaft 29 advances pin 130 past cam shoulder 129 releasing the second locking member which remains in its locked position with recess 136 registering with followers F5, and when cam recess 53 advances into engagement with follower F5, the follower advances to shift switch SW5 to its initial 5*b* position to deenergize motor M1 and terminate the cycle.

In the event that black coffee selector plate S1 is the selection, only feed motor M4 and valve solenoid L3 are energized during the vending cycle, the timing of motor M4 being controlled by switch SW15 and shaft driven cam C15. If the light coffee selector plate S2 is advanced, in addition to the activation of solenoid L3 and motor M4, selector yoke 86 is advanced to advance the retractors 32 of cam assemblies C1 and C3 to enable followers F1 and F3 to follow cam assemblies C1 and C3 so that the switches SW1 and SW2 are closed for short and long intervals respectively to energize the creamer feed motor M3 for a short or long interval depending on whether switch SW11 is open or finger closed. If the sugared coffee selector plate S3 is advanced, the same sequence occurs as in the case of the light coffee except that the upper yoke 84 is advanced to enable followers F2 and F4 and control sugar feed motor M2 whose short and long feed interval is controlled by switch SW10. The advance of light and sugared selector plate S4 advances both selector yokes 84 and 86 to effect both of the sugaring and creaming operations.

The advance of the tea selector plate S5 transfers switch SW12 to contact 12*b* and advances the retractors 32 of cam assemblies C3 and C4 to their follower enabling positions to cam control the closing of switches SW3 and SW4. Accordingly, tea feed motor M6 is energized by the cam closing of switch SW14, water valve solenoid L2 is energized during the dispensing cycle upon the transfer of switch SW5 to contact 5*a* and sugar and creamer feed motors M2 and M3 are energized during the cam closed intervals of switches SW4 and SW3 overlapping the respective manual closed intervals of switches SW10 and SW11. The advance of soup selector plate S6 transfers switch SW13 to contact 13*b* so as to energize valve solenoid L4 and energize soup powder feed motor M5 during the closing of switch SW16 by cam C16, none of the retractors 32 being advanced to a follower enabling position.

In order to bypass the coin actuation for the purpose of service vends accessible on the inside of vending cabinet or various "free vend" modes initiated directly by any push button 67, the solenoid 144 can be triggered in a number of different ways.

To get a free operation from the outside, switch SW8 will be switched to position 8*a* to activate the switch Sw9. Now any button 67 will energize solenoid 144 which in turn means that the locking member 121 will move directly from position of FIG. 2 to FIG. 7. Switch SW8 could be a two position switch operable by a timer giving a "free vend" only during a certain time of day or it can be operated by a key from outside giving a free vend to authorized personnel only.

Moreover, while the mechanism has been described as applied to the preparation of the coffee from instant powdered coffee, it may be highly effectively applied to machines where the cups of coffee are individually brewed from freshly ground coffee by simple modifications of the circuit network.

While there has been described and illustrated a preferred embodiment of the present invention, it is apparent that numerous alterations, omissions and additions may be made without departing from the spirit thereof.

I claim:

1. An electrical control mechanism comprising a control cam, means for rotating said control cam, a cam follower movable into engagement with said control cam, a switch movable between actuated and deactuated positions in response to the position of said cam follower, means responsive to the actuation of said switch, and means releasably retaining said cam follower in a retracted position independently of the position of said control cam, said retaining means comprising a retaining cam engaging said cam follower and rockable about the axis of said control cam independently of the rotation of said control cam between positions retracting and releasing said cam follower from following engagement with said control cam.

2. The electrical control mechanism of claim 1 including means responsive to an electrical pulse for rotating said control cam a single revolution.

3. The electrical control mechanism of claim 1 wherein said retaining cam is coaxially rotatably mounted on said control cam.

4. The electrical control mechanism of claim 1 wherein said control cam comprises a circular cam including radially raised and depressed portions and means for adjusting the lengths of said raised and depressed portions.

5. The electrical control mechanism of claim 1 comprising a plurality of said control cams coaxially positioned, said cam rotating means concurrently rotating said control cams, a cam follower movable into engagement with each of said control cams, a switch responsive to each of said cam followers, and said retaining means retaining said cam followers in their retracted positions and being actuatable to release selected of said cam followers.

6. The electrical control mechanism of claim 5 wherein said switches are opened and closed in the deactuated and actuated positions respectively and said switch responsive means comprises a plurality of electric motors and means connecting each of said motors in series with a respective switch to a source of current.

7. The electrical control mechanism of claim 5 wherein said switches are opened and closed in the deactuated and actuated positions respectively and a pair of said switches are connected in parallel and are actuated by respective followers engaging control cams with differently dimensioned raised and depressed cam surfaces and said switch responsive means comprises an electric motor and means connecting said electric motor in series with said parallel connected switches to a source of current.

8. The electrical control mechanism of claim 5 including a plurality of hand actuated buttons individually movable between advanced and retracted positions and means responsive to the advance of respective buttons for releasing preselected cam followers from their retained retracted condition.

9. The electrical control mechanism of claim 8 including first locking means movable between a release condition and a lock condition releasably locking a preselected button in its locked condition, a second locking means movable between a release condition and a lock condition releasably locking said first locking means in its lock condition and a third locking means releasably locking said second locking means in its release condition.

10. The electrical control mechanism of claim 9 including timing means for rotating said control cams a single revolution.

11. The electrical control mechanism of claim 10 including means responsive to the movement of said second locking means toward its lock conditions for actuating said timing means.

12. A selector mechanism comprising a plurality of selectively actuatable selector members individually movable between advanced and retracted positions, a first locking member movable in response to the advance of a selected selector member to an advanced position releasably locking said advanced selector member in its advanced position, a second locking member movable between an advanced position releasably locking said first locking member in its advanced position and a retracted position releasing said first locking member, electrically actuated means releasably locking said second locking member in its retracted position and a plurality of actuating members responsive to the advance of respective selector members.

13. The selector mechanism of claim 12 including spring means biasing said first locking member toward its retracted position and spring means biasing said second member toward its advanced position.

14. The selector mechanism of claim 12 wherein said first locking member comprises a first locking plate swingable about a longitudinal axis and having a plurality of longitudinally spaced latching openings formed therein, said selector members being transversely movable through said latching openings and having recesses in the edges thereof releasably engaging the edges of respective latching opening when a respective selector member is in its advanced position.

15. The selector mechanism of claim 14 wherein said second locking member comprises a second plate lying in a plane perpendicular to said first plate and swingable about a longitudinal axis and having a notch in an edge thereof releasably engaging said first locking member when said first and second locking members are in their advanced positions.

16. The selector mechanism of claim 12 including an electric timing motor and means responsive to the advance of said second locking member for energizing said timing motor.

17. The selector mechanism of claim 16 including means for deenergizing said motor when both said motor output is in a predetermined angular position and said locking member is retracted from its advanced position.

18. The selector mechanism of claim 12 including spring means biasing said second locking member to its advanced position, said second locking member including a locking shoulder, said locking means comprises a dog releasably engaging said shoulder and said electrically actuated releasable locking means comprises a dog releasably engaging said shoulder, an electric actuator, and responsive to the excitation of said electric actuator for retracting said dog from said shoulder.

* * * * *